US012108863B2

(12) United States Patent
Figueiredo

(10) Patent No.: US 12,108,863 B2
(45) Date of Patent: Oct. 8, 2024

(54) DEVICE FOR PACKAGING AND APPLYING A STICK OF PRODUCT, NOTABLY A COSMETIC PRODUCT, METHOD FOR INSERTION AND REMOVAL OF SAID STICK AND KIT FOR PRODUCTION OF AN ASSEMBLY COMPRISING SAID DEVICE

(71) Applicant: L'Oreal, Paris (FR)

(72) Inventor: Jean-Paul Figueiredo, Clichy (FR)

(73) Assignee: L'Oreal, Paris (FR)

( * ) Notice: Subject to any disclaimer, the term of this patent is extended or adjusted under 35 U.S.C. 154(b) by 502 days.

(21) Appl. No.: 17/416,196

(22) PCT Filed: Dec. 17, 2019

(86) PCT No.: PCT/EP2019/085724
§ 371 (c)(1),
(2) Date: Jun. 18, 2021

(87) PCT Pub. No.: WO2020/127321
PCT Pub. Date: Jun. 25, 2020

(65) Prior Publication Data

US 2022/0053914 A1 Feb. 24, 2022

(30) Foreign Application Priority Data

Dec. 18, 2018 (FR) ..... 1873200

(51) Int. Cl.
*A45D 40/16* (2006.01)
*A45D 40/00* (2006.01)
*A45D 40/02* (2006.01)

(52) U.S. Cl.
CPC ..... *A45D 40/16* (2013.01); *A45D 40/02* (2013.01); *A45D 2040/0043* (2013.01); *A45D 2040/0062* (2013.01)

(58) Field of Classification Search
CPC ..... A45D 40/16; A45D 40/02; A45D 2040/0043; A45D 2040/0062
(Continued)

(56) References Cited

U.S. PATENT DOCUMENTS 2,497,950 A * 2/1950 Lohr ..... A45D 40/16 206/229
2,753,991 A * 7/1956 Sherman ..... A45D 40/16 206/385

(Continued)

FOREIGN PATENT DOCUMENTS

CN 205568177 U 9/2016
EP 3148367 A1 4/2017

(Continued)

OTHER PUBLICATIONS

International Search Report mailed Mar. 19, 2020, issued in corresponding International Application No. PCT/EP2019/085724, filed Dec. 17, 2019, 2 pages.

*Primary Examiner* — Chun Hoi Cheung
(74) *Attorney, Agent, or Firm* — Christensen O'Connor Johnson Kindness PLLC

(57) ABSTRACT

A device (10) for packaging and applying a pasty product, notably a cosmetic product, comprising: a case (14); an external protective shell (30) mounted on the case (14) and provided on the interior surface thereof with at least one helical groove (36); a tubular element (40) mounted to rotate freely in said external protective shell (30), while being held axially relative to said shell and provided with at least one longitudinal groove (42); and a cup (20) supporting a stick (12) of product mounted to slide in said tubular element (40). The cup (20) comprises a lower cup (22) carrying the stud (23) and an upper cup (24) carrying the stick (12) of product and comprising an axial projection (24*c*) extending axially toward the base of the case (14) through an orifice (Continued)

(22*d*) provided on the lower cup (22), said lower and upper cups (22, 24) being integral via a "push-push" latch locking/unlocking system (50).

15 Claims, 5 Drawing Sheets

(58) Field of Classification Search
USPC ..... 206/385, 823, 581
See application file for complete search history.

(56) References Cited

U.S. PATENT DOCUMENTS

| | | | | |
|---|---|---|---|---|
| 5,649,777 | A * | 7/1997 | Holloway | A45D 40/16<br>401/74 |
| 6,568,529 | B2 * | 5/2003 | McMurrey | B65D 21/0228<br>206/385 |
| 9,723,907 | B2 * | 8/2017 | Huang | A45D 40/14 |
| 10,881,184 | B1 * | 1/2021 | Yan | A45D 40/06 |
| 11,129,463 | B2 * | 9/2021 | Dinata | A45D 40/12 |
| 11,517,098 | B2 * | 12/2022 | Nolan | A45D 40/14 |
| 2022/0087398 | A1 * | 3/2022 | Dunton | A45D 40/04 |

FOREIGN PATENT DOCUMENTS

| | | | |
|---|---|---|---|
| WO | 20150180115 | A1 | 12/2015 |
| WO | 20130086669 | A | 4/2018 |

* cited by examiner

DEVICE FOR PACKAGING AND APPLYING A STICK OF PRODUCT, NOTABLY A COSMETIC PRODUCT, METHOD FOR INSERTION AND REMOVAL OF SAID STICK AND KIT FOR PRODUCTION OF AN ASSEMBLY COMPRISING SAID DEVICE

The present invention relates to a device for packaging and applying a product, notably a cosmetic product.

"Cosmetic product" is understood to mean a product as defined in Regulation (EC) No 1223/2009 of the European Parliament and of the Council of 30 Nov. 2009 relating to cosmetic products.

More particularly, the invention relates to a device for packaging and applying a pasty product, such as lipstick, presented in the form of a stick or block.

Conventionally, a device for packaging and applying lipstick comprises a receptacle, a cup supporting the product and a mechanism for moving said cup.

The mechanism for moving the cup generally comprises:

a tubular slide element in which is slidably mounted the cup comprising at least one stud engaged in a slide; and a cylindrical shell in the wall of which provision is made for at least one helical groove, this shell being slipped over the tubular element and retained on the latter by axial stop means, the stud of the cup being engaged in a groove of the shell, forming a slide.

This type of mechanism allows the cup to be driven in rotation and/or in translation with a view to retracting the stick of cosmetic product inside the receptacle or to causing it to emerge therefrom such as to be accessible to a user.

Problems arise with this type of device, notably in connection with the refilling of the product.

Indeed, once the stick of cosmetic product has been used up, the entire receptacle is thrown away.

With a view to palliate this drawback, the prior art proposes receptacles with interchangeable or removable cups. However, the prior art removable cups are expensive and require overall modification of the device for packaging and applying the pasty product.

Patent application WO 2013 086 669-A1 describes a refillable lipstick device comprising a magnet enabling the lipstick to be held in the device and a refill plug provided with an extractor designed to engage with a magnetic dish equipped with the lipstick with a view to the removal thereof.

Reference may also be made to document U.S. Pat. No. 5,605,408-A1, which describes a refillable lipstick device comprising a lipstick seat comprising an exterior tube, an intermediate tube, an interior tube and a lifting seat. The exterior tube is integral with the intermediate tube provided with a spiral groove on the internal wall thereof. The interior tube is movable in rotation in the intermediate tube and comprises, on the lower part thereof, a plurality of perforations designed to interact with two stress plates forming jaws for holding the interior tube in a lipstick case.

However, a lipstick device of this type has a complex structure, consequently requiring significant modification of the structure of conventional lipstick devices.

It will thus be understood that there is a need to further improve refillable application devices and, notably, to reduce manufacturing costs by proposing an application device of simple design only requiring few modifications as compared to existing application devices.

A subject of the invention is a device for packaging and applying a stick of product or bar or block, for example a pasty product, notably a cosmetic product, comprising:

a case;

an external protective shell mounted on the case and provided on the interior surface thereof with at least one helical groove;

a tubular element mounted to rotate freely in said external protective shell, while being held axially relative to said shell and provided with at least one longitudinal groove.

The device further comprises a cup for supporting the stick of product mounted to slide in said tubular element between a storage position, in which the stick is at least in part accommodated inside the tubular element, and a use position, in which at least a part of the stick projects axially from the external shell, notably with a view to being applied on the user's epidermis. The cup comprises at least one stud engaged in the helical groove and the longitudinal groove.

The cup comprises two cup parts: a lower cup carrying the stud and an upper cup carrying the stick of product, one of the upper cup and the lower cup comprising an axial projection extending axially toward the other of the upper cup and the lower cup.

Thus, in a preferred embodiment, the cup comprises two cup parts: a lower cup carrying the stud and an upper cup carrying the stick of product and comprising an axial projection extending axially toward the lower cup.

In an alternative embodiment, the cup comprises two cup parts: a lower cup carrying the stud and an upper cup carrying the stick of product, the lower cup comprising an axial projection extending axially toward the upper cup.

The device further comprises a system for locking/unlocking the upper cup with the lower cup movable between a locked position, in which the axial projection interacts with said system, and an unlocked position, in which the axial projection is free relative to said system. Said system can be actuated from the unlocked position toward the locked position and vice versa via axial movement of the upper cup toward the lower cup.

The locking/unlocking system of the upper cup with the lower cup is a "push-push" or "push-to-lock/push-to-release" latch system and allows locking/unlocking with one and the same axial thrust action.

In the storage position, the axial projection is locked by the locking/unlocking system.

Advantageously, the locking/unlocking system comprises a casing mounted on the lower cup and a slide arranged and movable axially in said casing, said slide comprising at least two jaws that can move between the unlocked position, in which the axial projection is free relative to said jaws, and the locked position, in which the axial projection is blocked axially between the jaws, the movement of the jaws being obtained via the sliding of the slide in the casing.

For example, the casing of the system is formed directly on the lower cup.

Advantageously, the locking/unlocking system comprises a guide lever comprising a first end mounted in rotation on the slide and a second end, opposite the first end, mounted in a groove made on the casing. Said system further comprises a return member, such as, for example, a spring, mounted between the base of the casing and the slide and configured such as to elastically stress the slide toward the upper cup.

The guide groove is, for example, hollowed out in a lateral surface of said casing and receives the second end of the lever, movable in said groove.

This groove has a particular form configured such as axially to hold said second part of the lever in the locked position.

When the slide is pushed toward the casing through the action of an axial force resisting the force of the spring, the slide slides in the casing and the second end 56*b* moves in the guide groove and is blocked in a stop form of the groove. The distance between the jaws is reduced owing to the fact that they become inserted in the casing. Provision could be made for another mechanism configured such as to cause the jaws to pivot upon axial movement of the slide in the casing.

When the slide is again pushed toward the casing through the action of an axial force, the second end moves outside the stop form of the groove and the spring elastically stresses the slide toward the upper cup, which releases the jaws.

The spring is, for example, a helical spring.

For example, the axial projection comprises, close to the free end thereof, a shoulder configured such as to interact with the jaws of the locking/unlocking system in the locking position of said jaws.

In a variant, provision could be made for another form for the purpose of interaction with the locking/unlocking system, such as, for example, an annular groove or an annular bead.

For example, the lower cup is of cylindrical general form.

The device comprises, for example, a protective cap, for example a transparent cap, fixed on the upper cup, for example slipped over the cylindrical skirt of the upper cup.

The protective cap is in axial contact on the upper cup, the axial movement of the upper cup toward the lower cup being produced by axial pressure on said protective cap.

For example, the protective cap bears axially on the radial stud of the cylindrical skirt of the upper cup.

The protective cap is inserted inside the external protective shell.

The lower cup may, for example, comprise an upper cylindrical wall comprising, on the external lateral surface thereof, at least one stud projecting radially outward and a lower cylindrical guide skirt comprising an internal bore shaped such as to receive the locking/unlocking system.

For example, the cylindrical wall comprises two studs designed to interact with two helical grooves made on the external shell and two longitudinal grooves provided on the tubular element.

Each of these studs has a radial dimension sufficient to traverse the longitudinal groove of the tubular element and to engage in the corresponding helical groove of the external shell.

The cylindrical guide skirt may end at the free end thereof in an annular shoulder.

Advantageously, the staged casing comprises an upper part bearing axially on the shoulder of the lower cup.

The upper cup may, for example, comprise a cylindrical skirt for receiving the stick of product provided with a base at the lower end thereof and with the central axial projection extending axially from said base on the side opposite the stick of product.

The axial projection has, for example, the form of a cylindrical rod. In a variant, provision could be made for other forms for the axial projection.

According to a second aspect, the invention relates to a kit for production of an assembly for packaging and applying a stick of product, comprising, first, a device for packaging and applying a product as described above, and, second, at least one refill comprising an upper cup, a stick of cosmetic product and, preferably, a protective cap.

For example, the production kit comprises at least two refills mounted in a case.

For example, the case comprises locking/unlocking systems for the snap-fitting of the axial projections of the upper cup of the corresponding refill. Provision could also be made for the case to comprise a wall in the form of foam configured such as to receive each of the refills.

For example, the production kit comprises a protective cover mounted on the case such as to cover the refills overall.

The number of refills is not limited to three and could be two or more than three.

According to a third aspect, the invention relates to a method for insertion and removal of an assembly, comprising at least one of product and an upper cup in a device as described above, wherein, upon insertion of the assembly into the device, the assembly is inserted in the tubular element until the axial projection bears axially on the locking/unlocking system.

Advantageously, the axial bearing of the axial projection on the locking/unlocking system causes the jaws to move into the locking position via axial movement of the slide toward the base of the casing.

For example, upon removal of said assembly from the device, axial bearing is exerted on the axial projection such as to cause the jaws to move into the unlocking position via axial movement of the slide towards the upper cup, in such a manner as to detach the upper cup from the lower cup.

The present invention will be better understood from studying the detailed description of embodiments that are given by way of entirely non-limiting examples and are illustrated by the appended drawings, in which.

Figure 1:
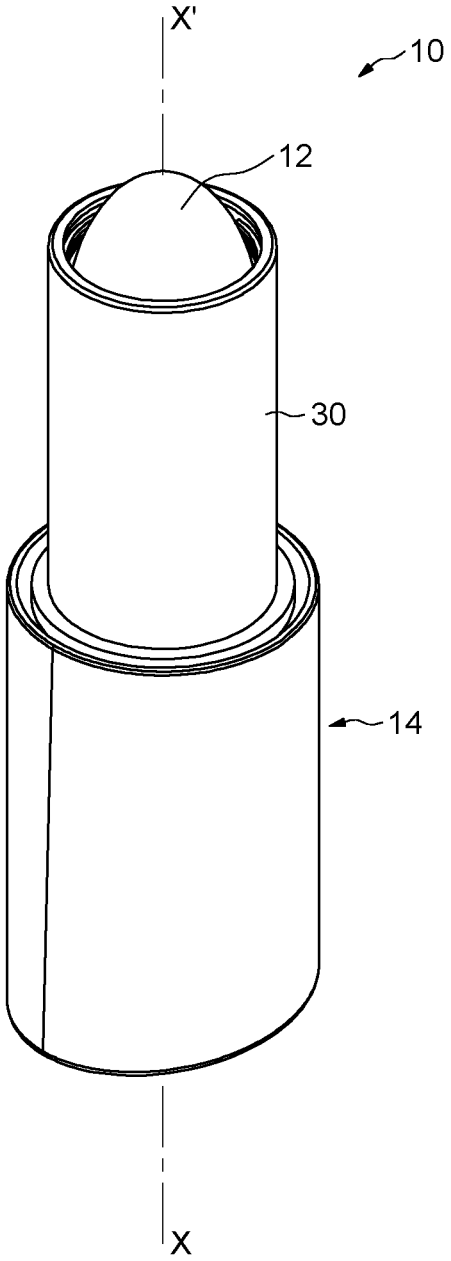
FIG. 1 illustrates, in perspective, a device for packaging and applying lipstick according to an embodiment of the invention.

FIG. 1 shows a device 10 for packaging and applying a pasty product, notably a stick 12 or block of lipstick. The device 10 extends along a longitudinal axis X-X'.

The device 10 comprises a case or receptacle 14 comprising an exterior container or exterior holder 16 and an interior container 18 mounted in said exterior container 16.

The exterior container 16 comprises a lateral wall 16*a*, for example a prismatic wall, a base wall 16*b* and an open end 16*c*, opposite the base wall 16*b* and delimiting an interior volume 16*d* for receiving the interior container 18.

The interior container 18 comprises a staged lateral cylindrical wall 18*a*, a base wall 18*b* and an open end 18*c*, opposite the base wall 18*b* and delimiting an interior volume 18*d*. As illustrated, the open end 18*c* comprises an annular radial border 18*e* configured such as to rest axially on the open ends 16*c* of the exterior container 16.

The interior container 18 is mounted securely in the exterior container 16, for example by sleeving, by adhesive bonding, or any other fixing means, such as to form a case unit 14.

The exterior container 16 is, for example, made from metallic material.

Figure 2:
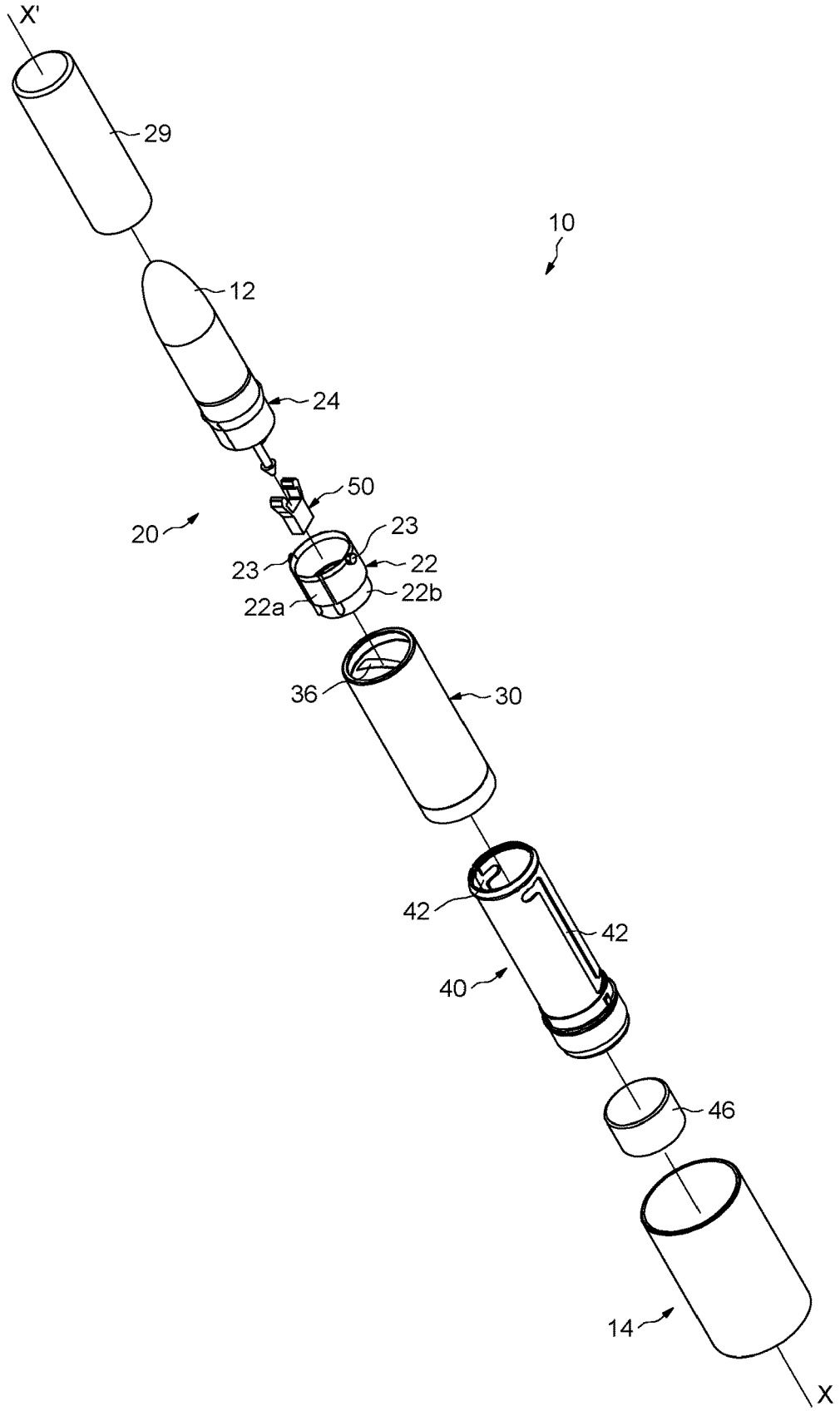
FIG. 2 illustrates, in expanded perspective, the device of FIG. 1.

The exterior container 16 is capped with a removable protective cap 29, visible in FIG. 2, which enables the device 10 to be closed in the storage position. In order to use and to apply lipstick, the protective cap 29 is removed from the case 14.

The device 10 further comprises a cup 24 supporting a pasty product, notably a cosmetic product, such as lipstick in the form of a stick or block of solid, slakable product. The cup 20 is designed to be mounted to slide in the case 14, and notably in an external protective shell 30 mounted on the case 14.

As illustrated, the external protective shell 30 is of cylindrical form, having a circular cross-section, and edge of which is folded down as a collar 32 toward the longitudinal axis X-X'. The edge 32 delimits a central circular passage 34 for the passage of the stick 12 of cosmetic product. The shelf 30 is mounted on the case 14, and notably on the interior container 18, such as to rotate freely relative to said interior container 18 while being held axially relative to said container 18.

The internal surface of the protective shell 30 comprises two identical and diametrically opposed helical grooves 36.

The device 10 further comprises a tubular element 40 acting as a drive mechanism for moving said cup relative to the external protective shell 30.

The tubular element 40 is sleeved in the external protective shell 30 and free to rotate relative to said shell 30 while being held axially relative to said shell 30.

The tubular element 40 is, for example, of circular cross-section and, for example, made from a synthetic material.

The tubular element 40 comprises two diametrically opposed longitudinal grooves 42 extending axially over practically the entire height of the tubular element 40. Each groove comprises two ends terminating, respectively, in a lateral notch (not referenced)

As illustrated, the cup 20 comprises two components: a first component 22, called the lower cup, configured such as to interact with the tubular element 40, and a second component 24, called the upper cup, capable of receiving the product.

The lower cup 22, of cylindrical general form, is mounted in the tubular element 40.

The lower cup 22 comprises an upper cylindrical wall 22*a* and a cylindrical guide skirt 22*b* which are separated from one another by a transverse wall 22*c*. The cylindrical guide skirt 22*b* terminates at the free end thereof in an annular shoulder 22*d* extending toward the longitudinal axis X-X'. The cylindrical guide skirt 22*b* further comprises an internal bore 22*e* with correspondence of form with a locking/unlocking system 50. The locking/unlocking system 50 of the upper cup 24 with the lower cup 22 will be described below.

As illustrated, the internal board 22*e* has a parallelepipedal cross section.

On the external lateral surface thereof, the cylindrical wall 22*a* comprises two studs 23 projecting radially outward.

Each of the studs 23 has a radial dimension sufficient to traverse the longitudinal groove 42 of the tubular element 40 and to engage in the corresponding helical groove 36 of the external shell 30.

The upper cup 24 comprises a cylindrical skirt 24*a* for receiving the stick 12 of cosmetic product provided with a base 24*b* at the lower end thereof and with a central axial projection 24*c* extending axially from the base 24*b* on the side opposite the stick 12 of cosmetic product. The axial projection 24*c* comprises, close to the free end thereof, a shoulder 24*d* configured such as to interact with the locking/unlocking system 50. In a variant, provision could be made for another form for the purpose of interaction with the locking/unlocking system 50, such as, for example, an annular groove or an annular bead.

As illustrated, the axial projection 24*c* has the form of a cylindrical rod. In a variant, provision could be made for other forms for the axial projection.

As illustrated in FIG. 2, the device 10 comprises the protective cap 29, for example a transparent cap, fixed on the upper cup 24, for example sleeved over the cylindrical skirt 24*a* of the upper cup 24.

The protective cap 29 bears axially on the radial stud (not referenced) of the cylindrical skirt 24*a* of the upper cup 24.

The protective cap 29 is inserted inside the external protective shell 30.

The locking/unlocking system 50 of the upper cup 24 with the lower cup 22 is a "push-to-lock/push-to-release" latch system and allows locking/unlocking with one and the same axial thrust action.

Figure 5:
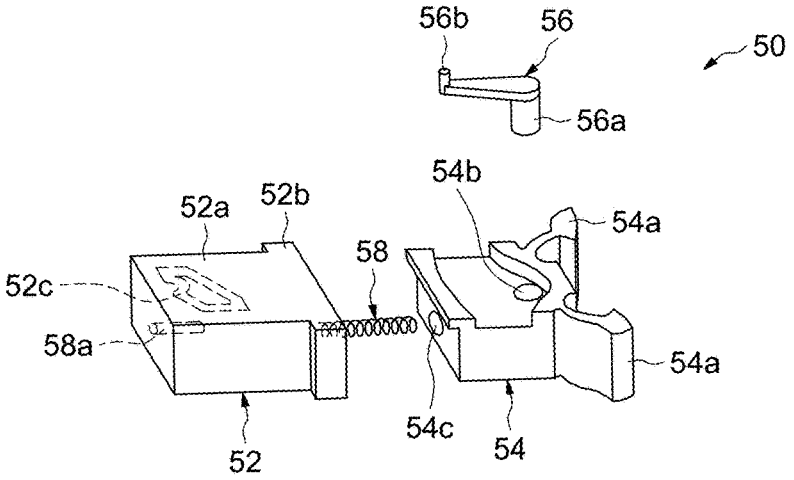
FIG. 5 shows, in expanded perspective, a locking/unlocking system according to an embodiment of the invention.
Figure 6:
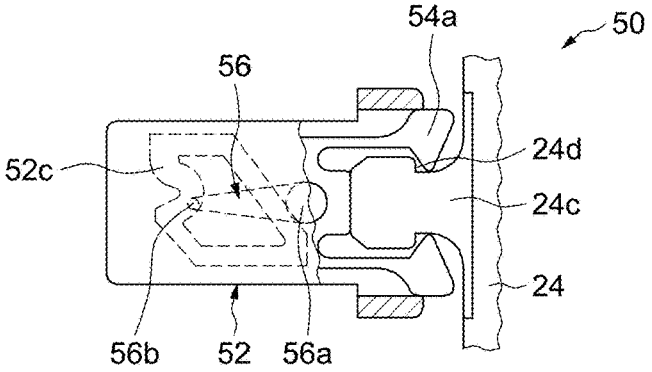
FIG. 6 is a view in cross section of the system of FIG. 4 in the locked position.

As illustrated in detail in FIGS. 5 and 6, the locking/unlocking system 50 comprises a staged casing 52 mounted in the lower cup 22 and comprising a lower part 52*a* extending through the passage 22*f* of the shoulder 22*d* of the lower cup 22 and an upper part 52*b* bearing axially on said shoulder 22*d*. In a variant, provision could be made for the casing 52 of the system 50 to be formed directly in the lower cup 22.

In a variant, provision could also be made for the axial projection 24*c* to be provided on the lower cup 22 and to interact with the system 50 carried, this time, by the upper cup 24.

The locking/unlocking system 50 further comprises a slide 54 arranged and movable axially in said casing 52, a guide lever or cam 56 and a spring 58, for example a helical spring.

The casing 52 comprises an opening (not referenced) for receiving the slide 54.

Figure 3:
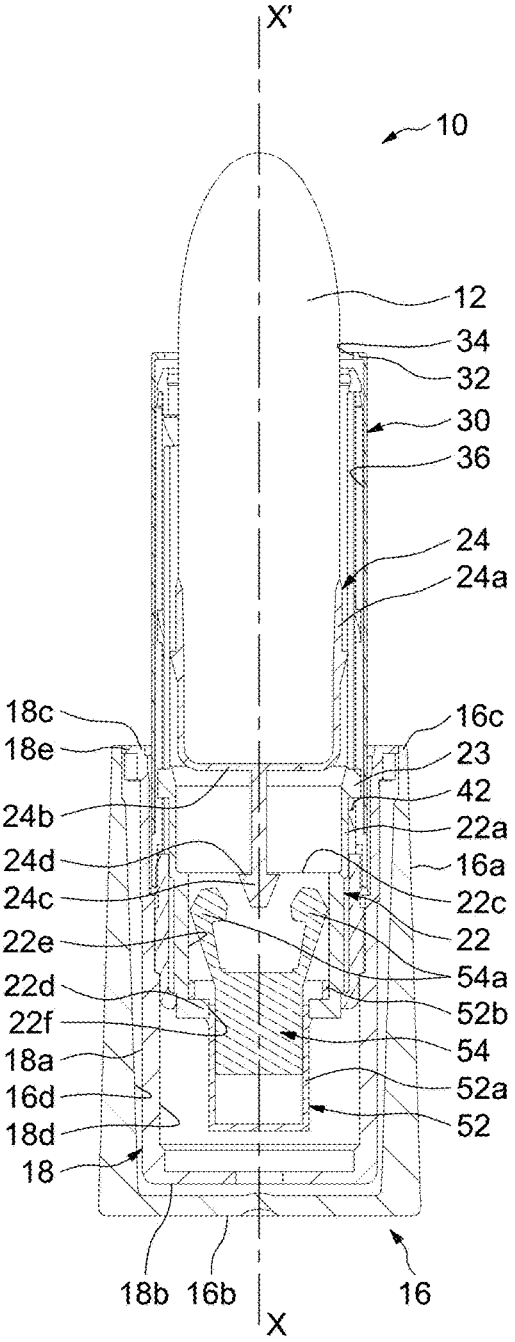
FIG. 3 shows a view, in longitudinal section, of the device of FIG. 1, in an unlocked position of the locking/unlocking system.
Figure 4:
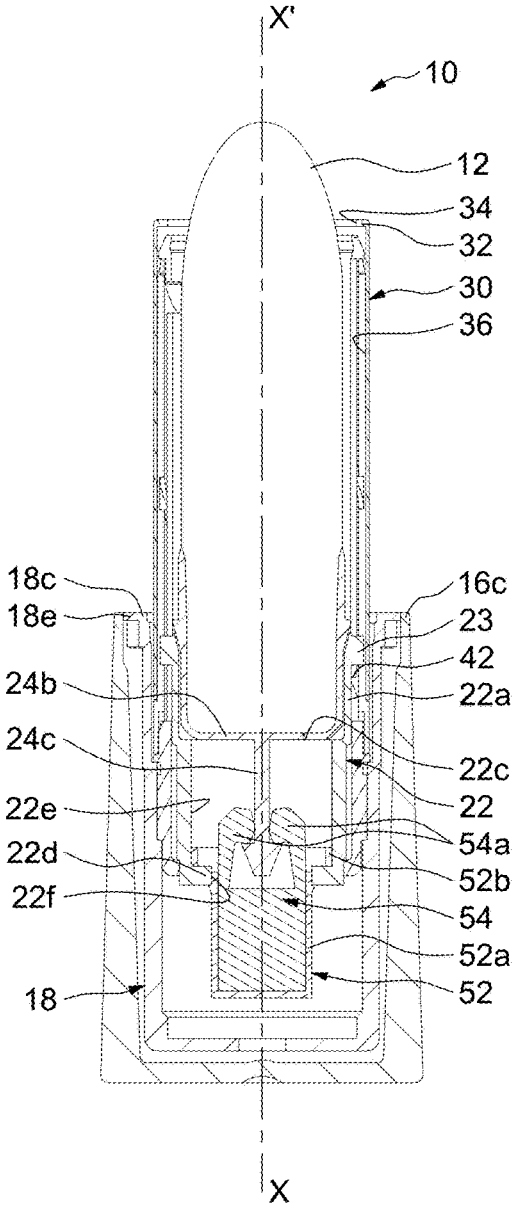
FIG. 4 shows a view, in longitudinal section, of the device of FIG. 1, in a locked position of the locking/unlocking system.
Figure 7:
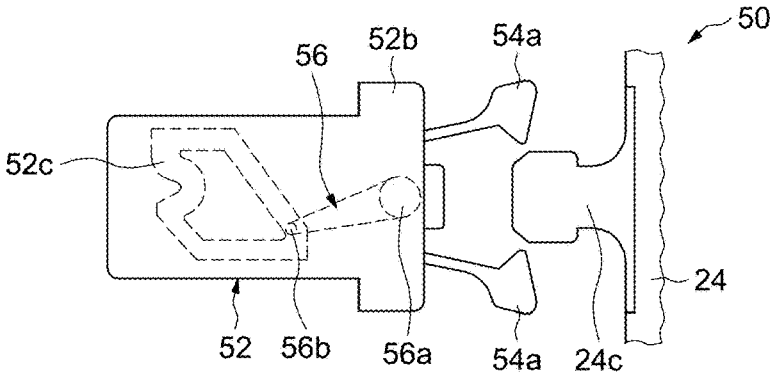
FIG. 7 is a view in cross section of the system of FIG. 4 in the unlocked position.

The slide 54 comprises two jaws 54*a* that can move between an unlocked position, visible in FIGS. 3 and 7, in which the axial projection 24*c* is free relative to said locking/unlocking system 50, and a locked position, visible in FIGS. 4 and 6, in which the axial projection 24*c* interacts with said locking/unlocking system 50.

The guide lever 56 comprises a first end 56*a* mounted to rotate in an orifice 54*b* made on a lateral surface of the slide 54. Said lever 56 further comprises a second end 56*b*, opposite the first end 56*a*.

The helical spring 58 is mounted between the base (not referenced) of the casing 52 and the slide 54, for example in a corresponding housing 54*c*. Said spring 56 is configured such as to elastically stress the slide 54 toward the opening of the casing 56 and thus toward the upper cup 24.

As illustrated, a support rod 58*a* is mounted on the base of the casing 52 such as laterally to support the spring 58.

The casing 52 comprises a guide groove 52*c* hollowed out in a lateral surface of said casing 52 and in which the second end 56*b* of the lever 56 is inserted. This groove 52*c* has a particular form configured such as axially to hold said second part 56*b* of the lever 56 in the locked position.

When the slide 54 is pushed toward the casing 52 through the action of an axial force resisting the force of the spring 58, the slide 54 slides in the casing 52 and the second end 56*b* moves in the guide groove 52*c* and is blocked in a stop form of the groove 52*c*, as visible in FIG. 6. The distance between the jaws 54*a* is reduced owing to the fact that they become inserted in the casing 52. Provision could be made for another mechanism configured such as to cause the jaws to pivot upon axial movement of the slide 54 in the casing 52.

When the slide 54 is again pushed toward the casing 52 through the action of an axial force, the second end 56*b* moves outside the stop form of the groove 52*c* and the spring 58 elastically stresses the slide 54 toward the upper cup 24, which releases the jaws 54*a*.

The movement of the jaws 54*a* is obtained by virtue of the sliding slide 54 in the casing 52.

In other words, securing and/or release of the two cups is achieved by nesting said components relative to one another by means of a simple downward axial pressure.

Provision could be made for other mechanisms that allow the locking/unlocking of the system to be driven by axial pressure on the protective cap 29 toward the case 14.

For example, provision could be made for a mechanism such as described in document EP 1 596 030, which relates to examples of locking/unlocking systems that can be driven by axial pressure.

In the storage position, the axial projection 24*c* of the upper cup 24 is locked by the locking/unlocking system 50, notably between the jaws 54*a*.

When the user turns the external shell 30 relative to the case 14, the cup 20 is rotated by means of the studs 23, which likewise drives the rotation of the tubular element 40. The cup 20 is then moved axially relative to the external shell 30 and to the tubular element 40 between a storage position of the block, in which the block is entirely accommodated inside the tubular element 40, and a use position, in which at least a part of the block projects from the external shell 30, with a view to being applied on the user's epidermis.

Upon mounting of the upper cup 24 on the lower cup 22, visible in FIG. 3, the assembly 28 formed by the upper cup 24, the stick 12 of product and the protective cap 29 is inserted, in the direction of the arrow F1 into the tubular element 40 until the axial projection 24*c* comes to bear axially on the slide 54 of the locking/unlocking system 50.

Axial bearing causes the jaws 54*a* to move into the locking position, visible in FIGS. 4 and 6.

Further axial bearing of the axial projection 24*c* on the slide 54 of the locking/unlocking system 50 causes the jaws 54*a* to move into the unlocking position, visible in FIGS. 3 and 7, in such a manner as to release the upper cup 24 from the lower cup 22. The assembly 28 formed by the upper cup 24, the stick 12 of cosmetic product and the protective cap 29 may be removed from the tubular element 40, for example by gripping of the protective cap 29.

Figure 8:
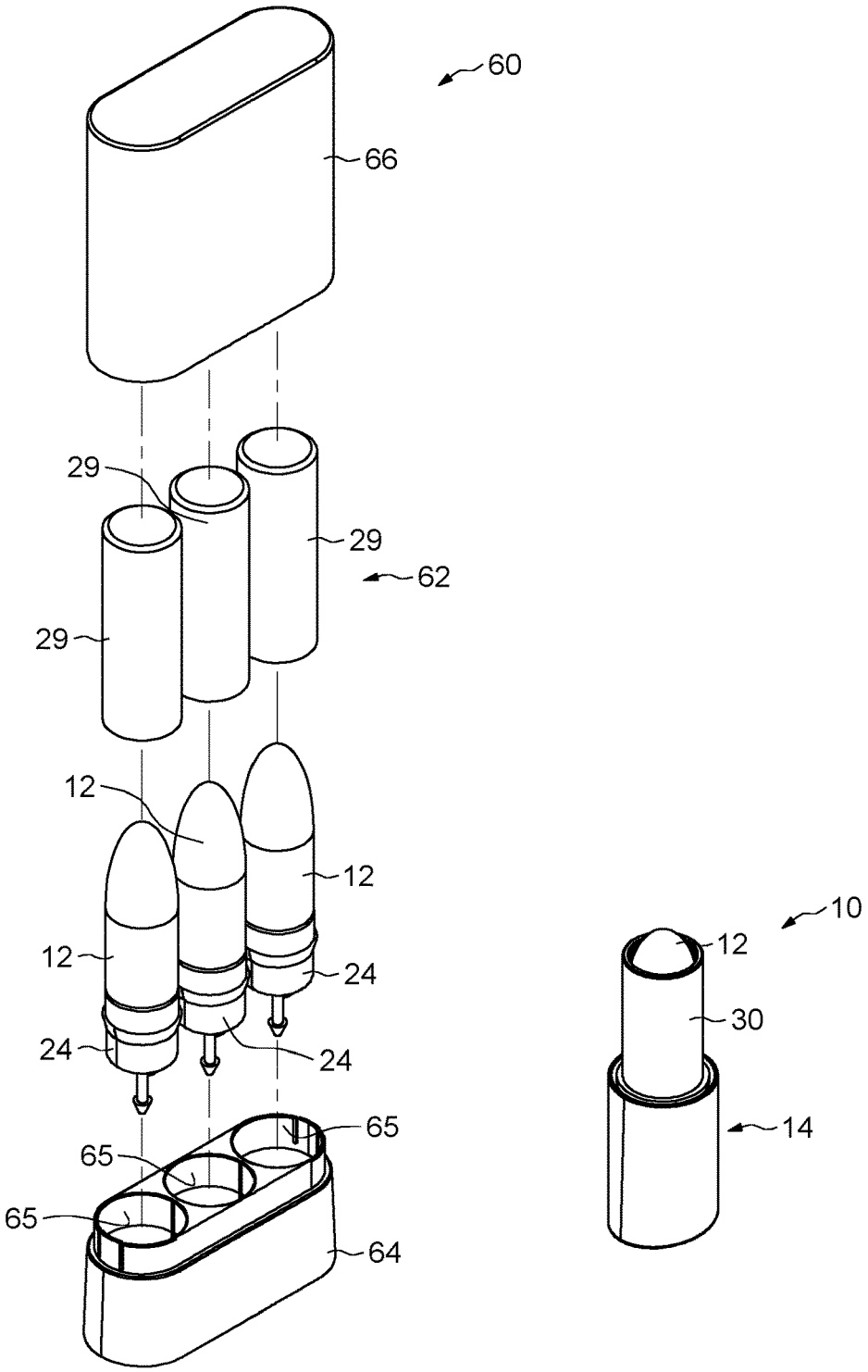
FIG. 8 shows an expanded view of a kit for production of a device for packaging and applying a cosmetic product according to a third embodiment of the invention.

As illustrated in FIG. 8, a kit 60 for production of an assembly for packaging and applying a product, comprises, first, a device 10 for packaging and applying a product as described above, and, second, three refills 62, each comprising the upper cup 24, a stick 12 of cosmetic product and the protective cap 29. The three refills 62 are mounted in a case 64 comprising three orifices 65 for receiving the corresponding upper cup 24. A protective top 66 is mounted on the case 64 in such a manner as to cover all the refills 62. The number of refills 62 is not limited to three and could be two or more than three. Provision could also be made for the case 64 to comprise a wall in the form of foam configured such as to receive each of the refills 62.

In a variant, provision could be made for a kit comprising, first, the device 10 and, second, a single refill 62 comprising the upper cup 24, a stick 12 of cosmetic product and the protective cap 29.

Thus, it is possible to have a plurality of different colours of lipstick and to interchange the upper cup/stick assemblies as required.

The cup according to the invention offers the advantage of proposing mechanical coupling between the upper and lower cups, without the involvement of a component of high cost.

Furthermore, this coupling is achieved by elastic deformation of snap-fit tabs, which makes it possible to avoid spoiling the stick of cosmetic product. Indeed, the upper cup that carries the stick of product does not experience radial mechanical stress and the stick that it carries remains intact, even upon a change of upper cup.

By virtue of the invention, a device for packaging and applying lipstick that is refillable and of simple design, with improved mounting/dismantling ergonomics, and which is intuitive for the user, is provided, the stick being changed by means of a single action.

The invention claimed is:

1. A device (10) for packaging and applying a stick (12) of product, notably a cosmetic product, comprising:

a case (14);

an external protective shell (30) mounted on the case (14) and provided on the interior surface thereof with at least one helical groove (36);

a tubular element (40) mounted to rotate freely in said external protective shell (30), while being held axially relative to said shell and provided with at least one longitudinal groove (42); and a cup (20) for supporting the stick (12) of product mounted to slide in said tubular element (40) between a storage position, in which the stick (12) is at least in part accommodated inside the tubular element (40), and a use position, in which at least a part of the stick (12) projects from the external shell (30), the cup comprising at least one stud (23) engaged in the helical groove (36) and the longitudinal groove (42):

the cup (20) comprising a lower cup (22) carrying the stud (23) and an upper cup (24) carrying the stick (12) of product, one of the upper cup (24) and the lower cup (22) comprising an axial projection (24*c*) extending axially toward the other of the upper cup (24) and the lower cup (22), and the device comprising:

a system (50) for locking/unlocking the upper cup (24) with the lower cup (22) movable between a locked position, in which the axial projection (24*c*) interacts with said system (50), and an unlocked position, in which the axial projection (24*c*) is free relative to said system (50), wherein said system (50) can be actuated from the unlocked position toward the locked position and vice versa via axial movement of the upper cup (24) toward the lower cup (22), and wherein the locking/unlocking system (50) comprises a casing (52) mounted on the lower cup (22) and a slide (54) arranged and movable axially in said casing (52), said slide (54) comprising at least two jaws (54*a*) that can move between the unlocked position, in which the axial projection (24*c*) is free relative to said jaws (54*a*), and the locked position, in which the axial projection (24*c*) is blocked axially between the jaws (54*a*), the movement of the jaws (54*a*) being obtained via the sliding of the slide (54) in the casing (52).

2. The device (10) as claimed in claim 1, wherein the casing (52) of the system (50) is directly formed on the lower cup (22).

3. The device (10) as claimed in claim 1, wherein the locking/unlocking system (50) comprises a guide lever (56) comprising a first end (56*a*) mounted in rotation on the slide (54) and a second end (56*b*), opposite the first end (56*a*), mounted in a groove (52*c*) made on the casing (52), said system (50) further comprising a return member (58) mounted between the base of the casing (52) and the slide (54) and configured such as to elastically stress the slide (54) toward the upper cup (24).

4. The device (10) as claimed in claim 1, wherein the axial projection (24*c*) comprises, close to the free end thereof, a shoulder (24*d*) configured such as to interact with the jaws (54*a*) of the locking/unlocking system (50) in the locking position of said jaws (54*a*).

5. The device (10) as claimed in claim 1, comprising a protective cap (29) fixed on the upper cup (24).

6. The device (10) as claimed in claim 5, wherein the protective cap (29) is in axial contact on the upper cup (24), the axial movement of the upper cup (24) toward the lower cup (22) being produced by axial pressure on said protective cap (29).

7. The device (10) as claimed in claim 1, wherein the lower cup (22) comprises an upper cylindrical wall (22*a*) comprising, on the external lateral surface thereof, at least one stud (23) projecting radially outward and a lower cylindrical guide skirt (22*b*) comprising an internal bore (22*e*) shaped such as to receive the locking/unlocking system (50).

8. The device (10) as claimed in claim 7, wherein the lower cylindrical guide skirt (22*b*) ends at the free end thereof, in the form of an annular shoulder (22*d*).

9. The device (10) as claimed in claim 1, wherein the axial projection (24*c*) has the form of a cylindrical rod.

10. The device (10) as claimed in claim 1, wherein the upper cup (24) comprises a cylindrical skirt (24*a*) for receiving the stick (12) of product provided with a base (24*b*) at the lower end thereof and with the central axial projection (24*c*) extending axially from the base (24*b*) on the side opposite the stick (12) of product.

11. A kit (60) for production of an assembly for packaging and applying a stick (12) of product, comprising, first, a device (10) for packaging and applying a product as claimed in claim 1, and, second, at least one refill (62) comprising an upper cup (24), a stick (12) of cosmetic product and a protective cap (29).

12. The production kit (60) as claimed in claim 11, comprising at least two refills (62) mounted in a case (64).

13. A method for insertion and removal of an assembly (28), comprising at least one stick (12) of product and an upper cup (24) in a device (10) as claimed in claim 1, wherein, upon insertion of the assembly (28) into the device (10), the assembly (28) is inserted in the tubular element (40) until the axial projection (24*c*) bears axially on the locking/unlocking system (50).

14. The insertion and removal method as claimed in claim 13, wherein the axial bearing of the axial projection (24*c*) on the locking/unlocking system (50) causes the jaws (54*a*) to move into the locking position via axial movement of the slide (54) toward the base of the casing (52).

15. The insertion and removal method as claimed in claim 14, wherein, upon removal of said assembly (28) from the device (10), axial bearing is exerted on the axial projection (24*c*) such as to cause the jaws (54*a*) to move into the unlocking position via axial movement of the slide (54) toward the upper cup (24).

* * * * *